US010350727B2

(12) United States Patent
Tan et al.

(10) Patent No.: US 10,350,727 B2
(45) Date of Patent: Jul. 16, 2019

(54) SANDING MACHINE HOUSING DEVICE

(71) Applicant: Robert Bosch GmbH, Stuttgart (DE)

(72) Inventors: AikHuan Tan, Kedah (MY); Siew Yuen Lee, Pulau Pinang (MY)

(73) Assignee: Robert Bosch GmbH, Stuttgart (DE)

( * ) Notice: Subject to any disclaimer, the term of this patent is extended or adjusted under 35 U.S.C. 154(b) by 237 days.

(21) Appl. No.: 14/916,541

(22) PCT Filed: Aug. 5, 2014

(86) PCT No.: PCT/EP2014/066793

§ 371 (c)(1),
(2) Date: Mar. 3, 2016

(87) PCT Pub. No.: WO2015/032564

PCT Pub. Date: Mar. 12, 2015

(65) Prior Publication Data

US 2016/0199962 A1 Jul. 14, 2016

(30) Foreign Application Priority Data

Sep. 3, 2013 (DE) ..... 10 2013 217 553

(51) Int. Cl.
*B24B 41/02* (2006.01)
*B25F 5/02* (2006.01)
*B24B 23/00* (2006.01)

(52) U.S. Cl.
CPC ..... *B24B 41/02* (2013.01); *B24B 23/005* (2013.01); *B25F 5/02* (2013.01)

(58) Field of Classification Search
CPC ..... B24B 23/005; B24B 41/02; B25F 5/02
See application file for complete search history.

(56) References Cited

U.S. PATENT DOCUMENTS 4,779,687 A * 10/1988 Schreiber ..... B23B 45/006 173/170
6,454,640 B1 * 9/2002 Siedler ..... B24B 23/02 451/357
D468,179 S * 1/2003 Hayakawa ..... D8/62
D527,966 S * 9/2006 Hayakawa ..... D8/62
D658,464 S * 5/2012 Kawase ..... D8/61
(Continued)

FOREIGN PATENT DOCUMENTS

CN 1321114 A 11/2001
CN 1413804 A 4/2003
(Continued)

OTHER PUBLICATIONS

Makita BGA452Z Parts List (May 2006).*
(Continued)

*Primary Examiner* — Marc Carlson
(74) *Attorney, Agent, or Firm* — Maginot, Moore & Beck LLP

(57) ABSTRACT

A sanding machine housing device includes at least one housing element and at least one energy accumulator receiving interface. The housing element at least partially defines a drive axle plane and an output axle plane. The energy accumulator receiving interface is arranged on the housing element and configured to receive at least one energy accumulator device in a releasable manner. The energy accumulator receiving interface includes at least one receiving guide element that has a main guide axis which is at least essentially transversal to the drive axle plane and the output axle plane.

19 Claims, 5 Drawing Sheets

(56) References Cited

U.S. PATENT DOCUMENTS

| | | | | |
|---|---|---|---|---|
| 8,852,776 | B2 * | 10/2014 | Bublitz | H01M 2/1066 173/217 |
| D722,853 | S * | 2/2015 | Takahashi | D8/61 |
| 2002/0100597 | A1 * | 8/2002 | Numata | B24B 23/028 173/217 |
| 2003/0017795 | A1 * | 1/2003 | Walker | B24B 23/04 451/356 |
| 2010/0087127 | A1 * | 4/2010 | Riedl | B24B 23/02 451/359 |
| 2012/0157257 | A1 * | 6/2012 | Hirabayashi | B24B 23/028 475/159 |
| 2013/0097878 | A1 | 4/2013 | Naito et al. | |
| 2013/0165026 | A1 * | 6/2013 | Sugita | B24B 23/02 451/357 |
| 2013/0165027 | A1 * | 6/2013 | Sugita | B24B 23/00 451/357 |
| 2013/0196203 | A1 * | 8/2013 | Wackwitz | B25F 5/00 429/96 |

FOREIGN PATENT DOCUMENTS

| | | | | |
|---|---|---|---|---|
| CN | 1953841 | A | 4/2007 | |
| CN | 1958235 | A | 5/2007 | |
| CN | 1958235 | B * | 7/2010 | |
| CN | 103056850 | A | 4/2013 | |
| CN | 103170892 | A | 6/2013 | |
| DE | 102 44 793 | A1 | 4/2004 | |
| DE | 10244793 | A1 * | 4/2004 | B24B 23/00 |
| DE | 10 2008 042 601 | A1 | 4/2010 | |
| DE | 10 2011 078 848 | A1 | 1/2013 | |
| EP | 0 238 718 | A1 | 9/1987 | |
| EP | 2 172 305 | A1 | 4/2010 | |
| EP | 2 607 016 | A2 | 6/2013 | |
| JP | 2009166147 | A * | 7/2009 | |
| JP | 2014148024 | A * | 8/2014 | B25F 5/00 |
| WO | WO 2005102603 | A1 * | 11/2005 | B24B 21/06 |

OTHER PUBLICATIONS

Makita BGA452Z Instruction Manual (Feb. 2006).*

JP 2014148024 A—Aug. 2014—English machine translation.*

International Search Report corresponding to PCT Application No. PCT/EP2014/066793, dated Jan. 9, 2015 (German and English language document) (5 pages).

* cited by examiner

SANDING MACHINE HOUSING DEVICE

This application is a 35 U.S.C. § 371 National Stage Application of PCT/EP2014/066793, filed on Aug. 5, 2014, which claims the benefit of priority to Serial No. DE 10 2013 217 553.1, filed on Sep. 3, 2013 in Germany, the disclosures of which are incorporated herein by reference in their entirety.

BACKGROUND

Sanding machine housing devices having a housing element which defines at least a drive axis and an output axis plane, and having an energy store receiving interface disposed on the housing element and adapted to receive, in a releasable manner, at least one energy storage device, wherein the energy store receiving interface comprises at least one receiving guide element, are already known.

SUMMARY

The disclosure is based on a sanding machine housing device having at least one housing element, which at least partially defines a drive axis and an output axis plane, and having at least one energy store receiving interface disposed on the housing element and adapted to receive, in a releasable manner, at least one energy storage device, wherein the energy store receiving interface comprises at least one receiving guide element.

It is proposed that the receiving guide element has a principal guide axis running at least substantially transversely to the drive axis and output axis plane. "Substantially transversely" should here be understood to mean, in particular, an orientation of a direction and/or of an axis relative to a reference direction and/or a reference axis, wherein the orientation of the direction and/or of the axis is at least different from an at least substantially parallel orientation to the reference direction and/or to the reference axis and, in particular, is arranged askew or perpendicular to the reference direction and/or to the reference axis. The housing element is preferably adapted to support bearing forces, such as, for instance, drive unit bearing forces, electronics unit bearing forces, etc. The housing element thus preferably comprises at least one bearing region, in which a bearing element is arrangeable, in particular a bearing element for a mounting of a drive element of a drive unit of a portable power tool comprising the sanding machine housing device. The drive axis and output axis plane is thus preferably defined by the at least one bearing region of the housing element. A position of the drive axis and output axis plane relative to the housing element is preferably defined in consequence of an arrangement of the bearing region. The bearing region is preferably formed by a bearing bush of the housing element. The drive axis and output axis plane is preferably configured as a plane in which a drive axis, in particular a rotational axis, of the drive unit of the portable power tool, in a state of the drive unit in which this is disposed in the housing element, in particular in a state in which it is supported in bearings in the housing element, extends. The drive axis thus runs preferably in the drive axis and output axis plane. Furthermore, an output axis of an output unit of the portable power tool runs preferably in the drive axis and output axis plane. Thus the output axis extends preferably in the drive axis and output axis plane. Moreover, the housing element is preferably adapted to receive and/or to surround components and/or units of the portable power tool and/or to protect these same from damage. "Adapted" should here be understood to mean, in particular, specially designed and/or specially equipped. By an object being adapted for a specific function should be understood, in particular, that the object fulfils and/or executes this specific function in at least one application state and/or operating state.

The energy store receiving interface is preferably configured as an accumulator receiving interface. The energy store receiving interface is thus preferably adapted to receive an energy storage device configured as an accumulator device. The energy storage device is preferably configured such that it can be slid into the energy store receiving interface or slipped onto the energy store receiving interface. Thus a connection of the energy storage device and of the energy store receiving interface is effected, in particular in consequence of a translatory movement of the energy storage device relative to the energy store receiving interface. Particularly preferably, the energy storage device, for arrangement on the energy store receiving interface, is guided at least by means of the receiving guide element along the principal guide axis of the receiving guide element. The receiving guide element is thus preferably configured as a slide-in guide element or as a slip-on guide element. The receiving guide element is preferably of rail-shaped or rib-shaped configuration. It is also conceivable, however, for the receiving guide element to have a different configuration which appears sensible to a person skilled in the art, such as, for instance, a configuration as a magnetic force guide rail, etc. By means of the inventive configuration of the sanding machine housing device, a compact arrangement of the energy store receiving interface on the housing element can advantageously be enabled, in particular in association with a particle collecting vessel interface, disposed on the housing element, of the sanding machine housing device. Moreover, a comfortable arrangement of the energy storage device on the energy store receiving interface can advantageously be enabled, in particular in association with a particle collecting device disposed on the particle collecting vessel interface.

It is further proposed that the sanding machine housing device comprises at least one vertical axis, with which a receiving guide plane of the energy store receiving interface, in which the principal guide axis runs, forms an angle which is less than 80°. In particular, the vertical axis and the receiving guide plane form an angle which is less than 60°, preferably is less than 40°, and particularly preferably is less than 32°. The angle is preferably measured on a side of the receiving guide plane which is facing toward the housing element. Moreover, the angle is preferably measured in a region, facing toward the tool holder, between the receiving guide plane and the vertical axis. The vertical axis runs preferably in the drive axis and output axis plane. In particular, the vertical axis extends at least substantially parallel to a direction of principal extent of the housing element. In this case, the vertical axis runs particularly preferably, at least in a state of the drive unit in which this is disposed on the housing element, at least substantially parallel to the drive axis of the drive unit. "Substantially parallel" should here be understood to mean, in particular, an orientation of a direction relative to a reference direction, in particular in a plane, wherein the direction in relation to the reference direction has a deviation in particular less than 8°, advantageously less than 5°, and particularly advantageously less than 2°. Particularly preferably, the principle guide axis runs at least substantially transversely to the vertical axis. In this case, in a state of the portable power tool comprising the sanding machine housing device, in which state this portable power tool is disposed on a workpiece, the vertical axis runs at least substantially perpendicular to a workpiece surface of the workpiece. The term "substantially perpendicular" is here meant to define, in particular, an orientation of a direction relative to a reference direction, wherein the direction and the reference direction, in particular viewed in a plane, form an angle of 90° and the angle has a maximum deviation of, in particular, less than 8°, advantageously less than 5°, and particularly advantageously less than 2°. Furthermore, the vertical axis runs preferably at least substantially perpendicular to a grip surface of the housing element. Given correct handling of the sanding machine housing device, in particular of the portable power tool comprising the sanding machine housing device, the grip surface is preferably adapted as a support surface for a palm of an operator. Thus the vertical axis runs, in particular, at least substantially perpendicular to a tangent of the grip surface. By means of the inventive configuration of the sanding machine housing device, an ergonomically manageable energy store receiving interface can advantageously be realized. Moreover, a space-saving arrangement of the energy store receiving interface in the region of a particle collecting vessel interface of the sanding machine housing device can advantageously be achieved. In particular, a comfortable arrangement of a particle collecting vessel on the particle collecting vessel interface in a state of the energy storage device in which this is disposed on the energy store receiving interface can be enabled particularly advantageously.

It is further proposed that the energy store receiving interface is disposed on a longitudinal side of the housing element. The longitudinal side of the housing element preferably has a principal extent which runs along a direction running at least substantially parallel to the drive axis and output axis plane. Preferably, the longitudinal side of the housing element has the greatest overall extent in comparison to the further sides of the housing element. By means of the inventive configuration, an arrangement of the energy store receiving interface close to a center of gravity of the sanding machine housing device, in particular close to a center of gravity of the portable power tool comprising the sanding machine housing device, can be achieved particularly advantageously. Thus a comfortable operability of the portable power tool comprising the sanding machine housing device can advantageously be enabled. Moreover, the sanding machine housing device can advantageously be designed particularly ergonomically.

Moreover, it is proposed that the energy store receiving interface comprises at least one assembly region, which has at least one fastening element for fastening the energy store receiving interface to the housing element, which latter, viewed in a state mounted on the housing element, has a fastening axis running at least substantially transversely to the drive axis and output axis plane. The fastening element thus preferably has a fastening axis which runs at least substantially parallel to the principal guide axis of the receiving guide element. In particular, at least a large part of a fastening force acts to fasten the energy store receiving interface to the housing element along the fastening axis of the fastening element. It is also conceivable, however, for the fastening element to have a principal extent which runs at least substantially transversely to the principal guide axis of the receiving guide element. By means of the inventive configuration of the sanding machine housing device, a constructively simple installability of the energy store receiving interface can advantageously be achieved, in particular where the sanding machine housing device is configured in shell construction. Moreover, an advantageous direction of action of a fastening force which is directed counter to a slide-in direction of the energy storage device can be achieved. A stable arrangement of the energy store receiving interface on the housing element can thus be achieved particularly advantageously.

It is further proposed that the sanding machine housing device comprises at least one damping unit, which is disposed at least between the housing element and the energy store receiving interface. A "damping unit" should here be understood to mean, in particular, a unit comprising at least one component which is preferably adapted to reduce a transmission of vibrations from the housing element to the energy store receiving interface. In this case, the damping unit advantageously at least partially serves to insulate and/or dampen vibration of the energy store receiving interface. Preferably, the damping unit can be configured, moreover, as a sealing unit, which is adapted to at least a very large extent to prevent penetration of moisture and/or dirt at least in the region between the housing element and the energy store receiving interface. Furthermore, it is conceivable for the sanding machine housing device to have at least one insulating unit for thermal insulation between the housing element and the energy store receiving interface. By means of the inventive configuration, a broad vibration decoupling of the energy store receiving interface, in particular from vibrations of the drive unit, can advantageously be achieved. A component-gentle arrangement of an energy storage device on the energy store receiving interface can thus be enabled.

It is further proposed that the sanding machine housing device comprises at least one assembly guide unit, which is adapted to guide the energy store receiving interface during mounting on the housing element. The assembly guide unit is preferably adapted to form a positive and/or non-positive connection between the housing element and the energy store receiving interface, in particular at least during an assembly operation. Preferably, the assembly guide unit is adapted to form a positive connection acting at least substantially parallel to the drive axis and output axis plane. A comfortable mounting of the energy store receiving interface on the housing element can thus advantageously be achieved.

Moreover, it is proposed that the assembly guide unit comprises at least one rib-shaped assembly guide element, disposed in an assembly region of the energy store receiving interface, for a positive and/or non-positive connection to the housing element. It is also conceivable, however, for the assembly guide element to have a different configuration which appears sensible to a person skilled in the art, such as, for instance, a rod-shaped configuration, a pin-shaped configuration, etc. By means of the inventive configuration of the sanding machine housing device, the assembly guide unit can be realized in a constructively simple manner.

It is further proposed that the sanding machine housing device comprises at least one further housing element, which is connectable to the first housing element in a separation plane running at least substantially parallel to the drive axis and output axis plane. Thus the sanding machine housing device has particularly preferably a shell construction. Preferably, the housing element and the further housing element are fastened to each other by means of at least one connecting element of the sanding machine housing device. The connecting element is preferably configured as a screwing element, in particular as a screw. It is also conceivable, however, for the connecting element to have a different configuration which appears sensible to a person skilled in the art, such as, for instance, a configuration as a bayonet lock element, as a latching element, as a toggle lever element, as a clip element, as a rivet element, etc. By means of the inventive configuration of the sanding machine housing device, a constructive fixing of the energy store receiving interface to the housing element and to the further housing element can be achieved.

In addition, a portable power tool, in particular a sanding machine, having at least one sanding machine housing device according to the disclosure is proposed. A "portable power tool" should here be understood to mean, in particular, a power tool for machining of workpieces, which power tool can be transported without a transport machine by an operator.

The portable power tool has, in particular, a mass which is less than 40 kg, preferably less than 10 kg, and particularly preferably less than 5 kg. Preferably, the portable machine tool is configured as a sanding machine. In this case, the portable power tool can be configured as an angle sander, as an orbital sander, as an eccentric sander, as a delta sander, as an abrasive belt sander, etc. By means of the inventive configuration, a portable power tool which is comfortable to handle can advantageously be achieved.

Moreover, it is proposed that the portable power tool comprises at least one tool holder, which has at least one tool holder motional plane, wherein the principal guide axis runs at least substantially parallel to the tool holder motional plane. A "tool holder motional plane" should here be understood to mean, in particular, a plane in which at least two points present on a tool holder of the portable power tool are moved during driving of the tool holder. By means of the inventive configuration, a compact arrangement of the energy store receiving interface on the housing element can advantageously be achieved. Moreover, a high ease of use for an operator can be realized, since a comfortable connection of the energy storing device to the energy store receiving interface can be enabled.

The sanding machine housing device according to the disclosure and/or the portable power tool according to the disclosure should here not be limited to the above-described application and embodiment. In particular, for fulfillment of a herein described working method, the sanding machine housing device according to the disclosure and/or the portable power tool according to the disclosure can have a number which differs from a herein stated number of individual elements, components and units.

BRIEF DESCRIPTION OF THE DRAWINGS

Further advantages emerge from the following drawing description. In the drawing, an illustrative embodiment of the disclosure is represented. The drawing, the description and the claims contain numerous features in combination. The person skilled in the art will expediently also view the features individually and put them together into sensible further combinations.

DETAILED DESCRIPTION

Figure 1:
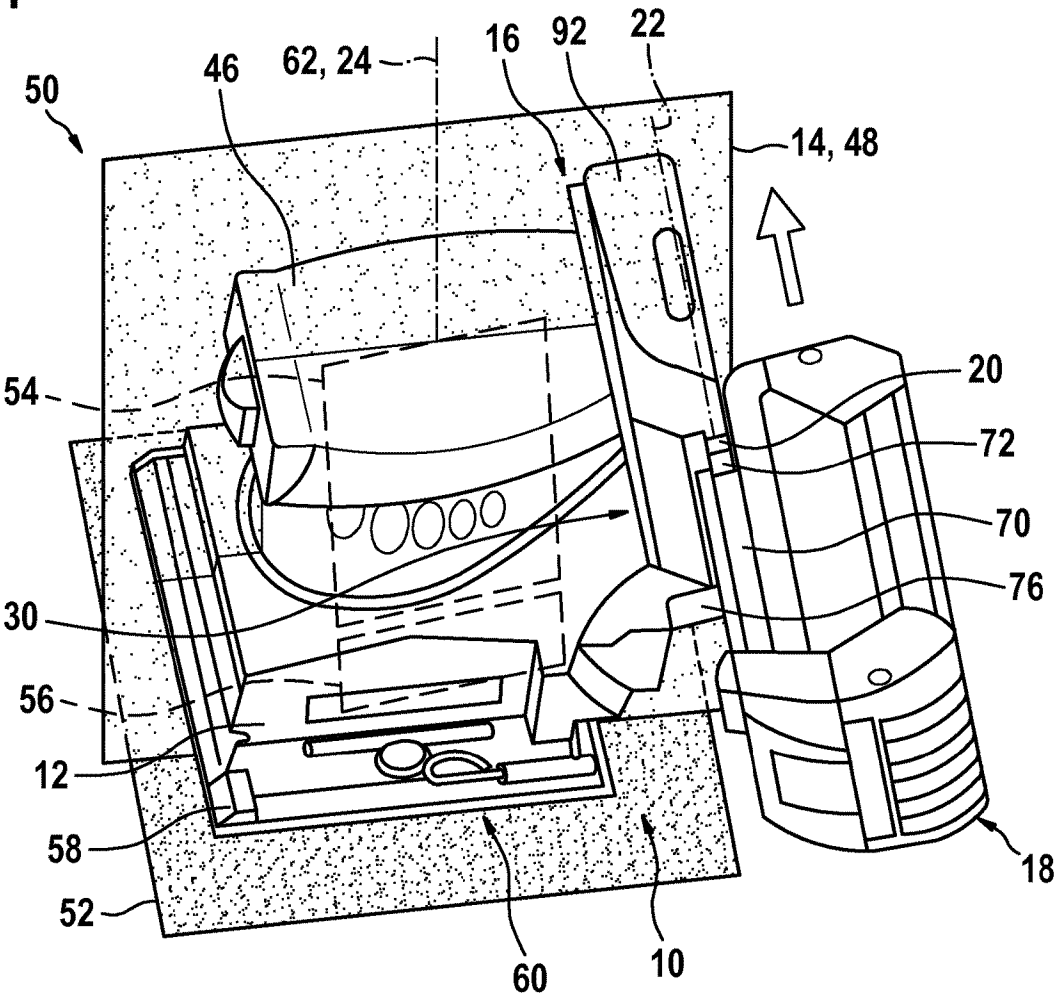
FIG. 1 shows in a schematic representation a portable power tool system according to the disclosure, having a portable power tool according to the disclosure which comprises at least one sanding machine housing device according to the disclosure, and having an energy storage device.

FIG. 1 shows a portable power tool system having at least one portable power tool 50, which comprises at least one sanding machine housing device 10, and having at least one energy storage device 18. The portable power tool 50 is configured as a battery operated portable power tool 50. The energy storage device 18 is thus configured as an accumulator device. The energy storage device 18 here has a configuration which is already known to a person skilled in the art. The portable power tool 50 is configured as a sanding machine, in particular as an eccentric sander. The portable power tool 50 here has at least a drive unit 54 and an output unit 56. The drive unit 54 and the output unit 56 are disposed at least partially in the sanding machine housing device 10. The sanding machine housing device 10 is thus adapted to receive the drive unit 54 and the output unit 56. The drive unit 54 and the output unit 56 are adapted to drive a machining tool (not represented in detail here) arrangeable on a tool holder 58 of the portable power tool 50. The tool holder 58 is configured as an abrasive holder, to which the machining tool is fixable by means of a holding unit 60 of the portable power tool 50 in a manner which is already known to a person skilled in the art. The holding unit 60 can be configured as a Velcro holding unit, a clamping holding unit, a self-adhesive holding unit, etc. The machining tool is configured as an abrasive sheet. It is also conceivable, however, for the machining tool to have a different configuration which appears sensible to a person skilled in the art, such as, for instance, a configuration as a polishing sheet, etc. The tool holder 58 can here be driven by means of an interaction of the drive unit 54 and the output unit 56, in a manner which is already known to a person skilled in the art, such that it oscillates eccentrically about a rotational axis of the tool holder 58. The rotational axis of the tool holder 58 runs at least substantially parallel to a drive axis 62 of the drive unit 54. The drive unit 54 is configured as an electric motor unit. The drive axis 62 of the drive unit 54 is thus formed by a rotational axis of an armature shaft of the drive unit 54. The output unit 56 is adapted to support the tool holder 58 in bearings such that this is eccentrically movable relative to the drive axis 62. The output unit 56 can here be configured such that it can be switched in order to influence, for instance, an oscillation rate of the tool holder 58.

Figure 4:
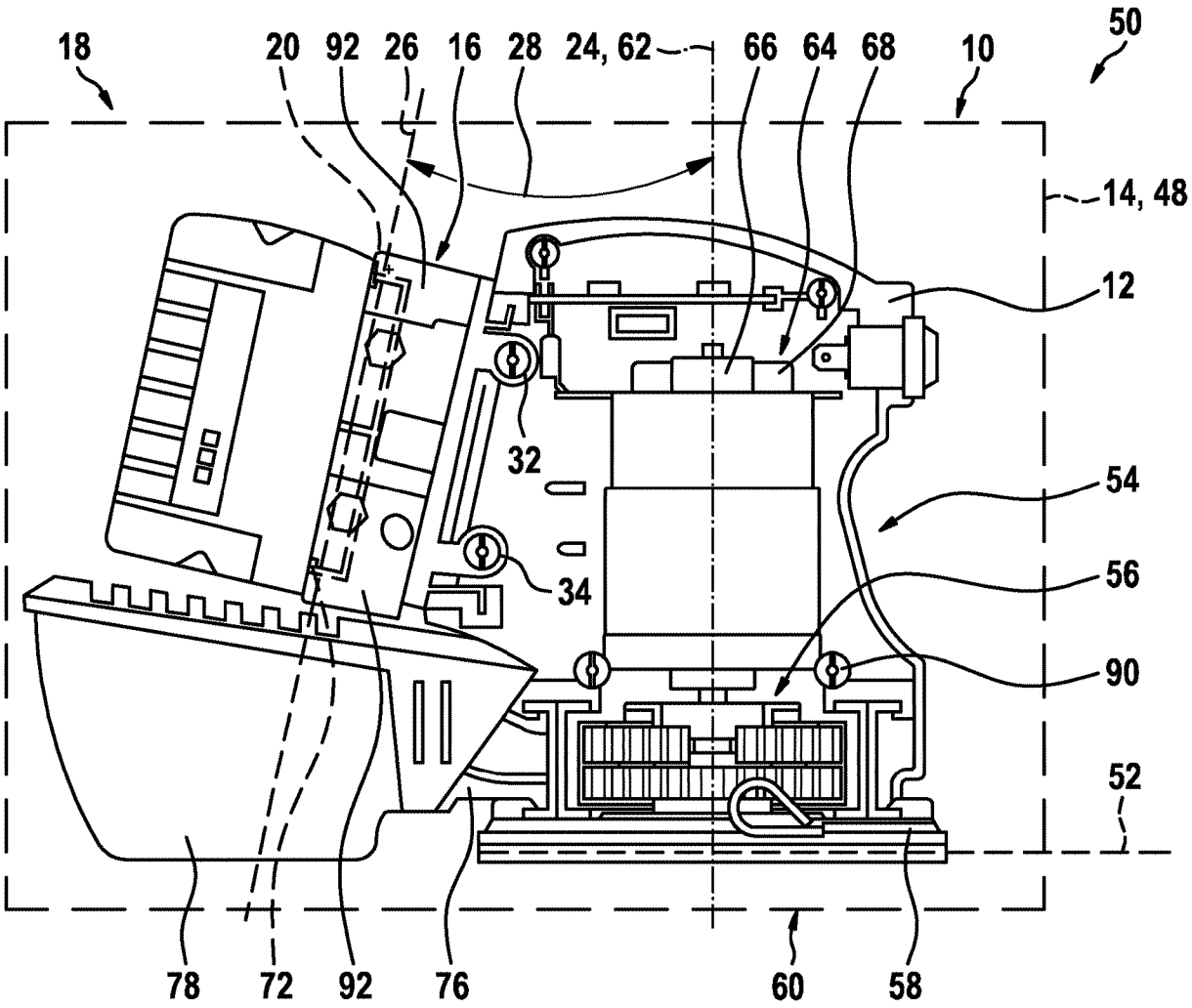
FIG. 4 shows in a schematic representation a further detailed view of the sanding machine housing device according to the disclosure in a state of the housing element and of the further housing element of the sanding machine housing device according to the disclosure, in which state these are disassembled from each other.
Figure 5:
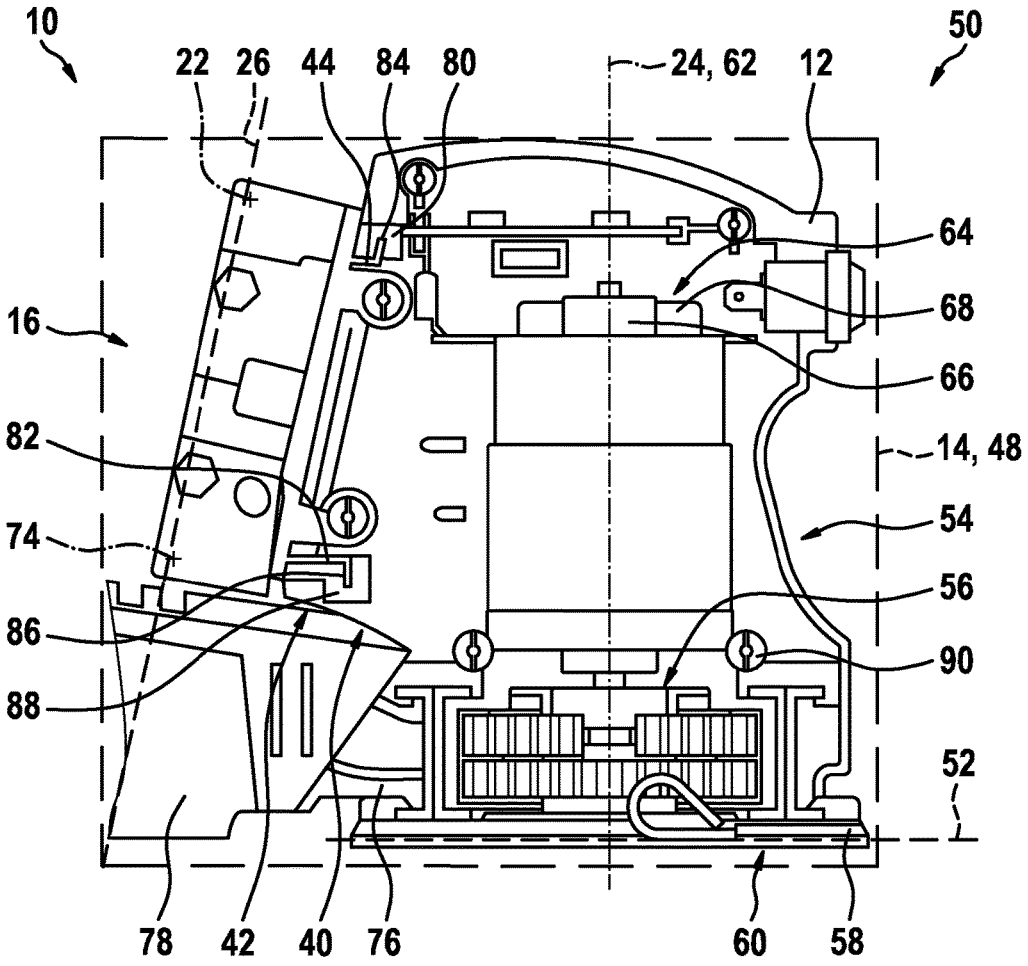
FIG. 5 shows in a schematic representation a further detailed view of the sanding machine housing device according to the disclosure in a state of the housing element and of the further housing element of the sanding machine housing device according to the disclosure, in which state these are disassembled from each other.

The sanding machine housing device 10 comprises at least one housing element 12, which defines at least one drive axis and output axis plane 14, and at least one energy store receiving interface 16, disposed on the housing element 12, for the releasable reception of at least one energy storage device 18, wherein the energy store receiving interface 16 comprises at least one receiving guide element 20. The housing element 12 comprises at least one bearing region 64, in which a bearing element 66 (FIGS. 4 and 5) of the portable power tool 50 can be arranged to form a mounting of the drive unit 54. The bearing element 66 is configured as a roller bearing. It is also conceivable, however, for the bearing element 66 to have a different configuration which appears sensible to a person skilled in the art. For reception of the bearing element 66, the bearing region 64 comprises a bearing bush 68 (FIGS. 4 and 5). The bearing bush 68 has a semicircular configuration. The drive axis and output axis plane 14 is here defined by the bearing bush 68, in particular by an arrangement of the bearing bush 68 in the housing element 12. Two faces of the housing element 12, which delimit the bearing bush 68, thus run in the drive axis and output axis plane 14. The drive axis 62 here runs in the drive axis and output axis plane 14. Moreover, the rotational axis of the tool holder 58 runs in the drive axis and output axis plane 14. In addition, the drive axis and output axis plane 14 runs at least substantially perpendicular to a tool holder motional plane 52 of the tool holder 58. In consequence of a drive by means of the drive unit 54 and the output unit 56, the tool holder 58 is moved oscillatingly in the tool holder motional plane 52 of the tool holder 58. The tool holder motional plane 52 runs at least substantially perpendicular to the drive axis 62 of the drive unit 54. The drive axis and output axis plane 14 thus comprises the drive axis 62 of the drive unit 54 and the rotational axis of the tool holder 58 and runs at least substantially perpendicular to the tool holder motional plane 52 of the tool holder 58. In addition, the tool holder motional plane 52 forms with the receiving guide plane 26, viewed on a side facing toward the energy storage device 18, an angle which is greater than 89° and is less than 140°.

The receiving guide element 20 has a principal guide axis 22 running at least substantially transversely to the drive axis and output axis plane 14. The principal guide axis 22 of the receiving guide element 20 runs at least substantially parallel to the tool holder motional plane 52. The receiving guide element 20 has a rail-like or rib-shaped configuration. Moreover, the receiving guide element 20 is configured correspondingly to an insertion guide recess 70 of the energy storage device 18. The insertion guide recess 70 of the energy storage device 18 here has in this case a configuration which is already known to a person skilled in the art. The insertion guide recess 70 is thus disposed on a side wall of the energy storage device 18. During an arrangement of the energy storage device 18, the receiving guide element 20 is slid into the insertion guide recess 70. As a result, the energy storage device 18, during a movement relative to the energy store receiving interface 16, is guided for arrangement on the energy store receiving interface 16 by means of an interaction of the receiving guide element 20 and the insertion guide recess 70. For arrangement of the energy storage device 18 on the energy store receiving interface 16, the energy storage device 18 is here moved at least substantially transversely to the drive axis and output axis plane 14. The energy storage device 18 can thus be slid laterally into the energy store receiving interface 16. The energy store receiving interface 16 has in total at least two receiving guide elements 20, 72 (FIG. 5). It is also conceivable, however, for the energy store receiving interface 16 to have a number of receiving guide elements 20, 72 which differs from two. The at least two receiving guide elements 20, 72 are disposed on two opposite sides of the energy store receiving interface 16. In this case, the at least two receiving guide elements 20, 72 respectively have a principal guide axis 22, 74. A receiving guide plane 26 of the energy store receiving interface 16 comprises principal guide axes 22, 74 of the at least two receiving guide elements 20, 72. In a state disposed on the energy store receiving interface 16, the energy storage device 18 is fixed by means of a fixing unit (not represented in detail here) which is already known to a person skilled in the art.

The sanding machine housing device 10 comprises at least one vertical axis 24, with which the receiving guide plane 26, in which at least the principal guide axis 22 runs, forms an angle 28 which is less than 80°. The angle 28 which is formed by the receiving guide plane 26 and the vertical axis 24 is here less than 32°. The vertical axis 24 runs coaxially to the drive axis 62. Viewed along a direction running at least substantially parallel to the vertical axis 24, the housing element 12 has a maximum extent. At least one longitudinal side 30 of the housing element 12 thus runs along the direction running at least substantially parallel to the vertical axis 24. The energy store receiving interface 16 is here disposed at least partially on the longitudinal side 30 of the housing element 12. The at least two receiving guide elements 20, 72 are thus likewise disposed on the longitudinal side 30 of the housing element 12.

The housing element 12 further has a connecting branch 76 of a particle collecting vessel interface of the sanding machine housing device 10 for connection to a particle collecting vessel 78 (FIGS. 4 and 5). The connecting branch 76 is disposed at least partially on the longitudinal side 30 of the housing element 12. In this case, the energy store receiving interface 16 is disposed in the region of the connecting branch 76 on the longitudinal side 30 of the housing element 12. Viewed along the direction running at least substantially parallel to the vertical axis 24, the energy store receiving interface 16 is disposed, starting from the tool holder 58, above the connecting branch 76.

The energy store receiving interface 16 further has at least one assembly region, which has at least one fastening element 32 for fastening of the energy store receiving interface 16 to the housing element 12, which fastening element, viewed in a state mounted on the housing element 12, has a fastening axis 36 running at least substantially transversely to the drive axis and output axis plane 14. In total, the energy store receiving interface 16 has at least two fastening elements 32, 34 for fastening the energy store receiving interface 16 to the housing element 12, which respectively comprise a fastening axis 36, 38 running at least substantially transversely to the drive axis and output axis plane 14. It is also conceivable, however, for the energy store receiving interface 16 to comprise a number of fastening elements 32, 34 which differs from two. The fastening elements 32, 34 are here configured as screw receiving sleeves. It is also conceivable, however, for the fastening elements 32, 34 to have a different configuration which appears sensible to a person skilled in the art.

Figure 2:
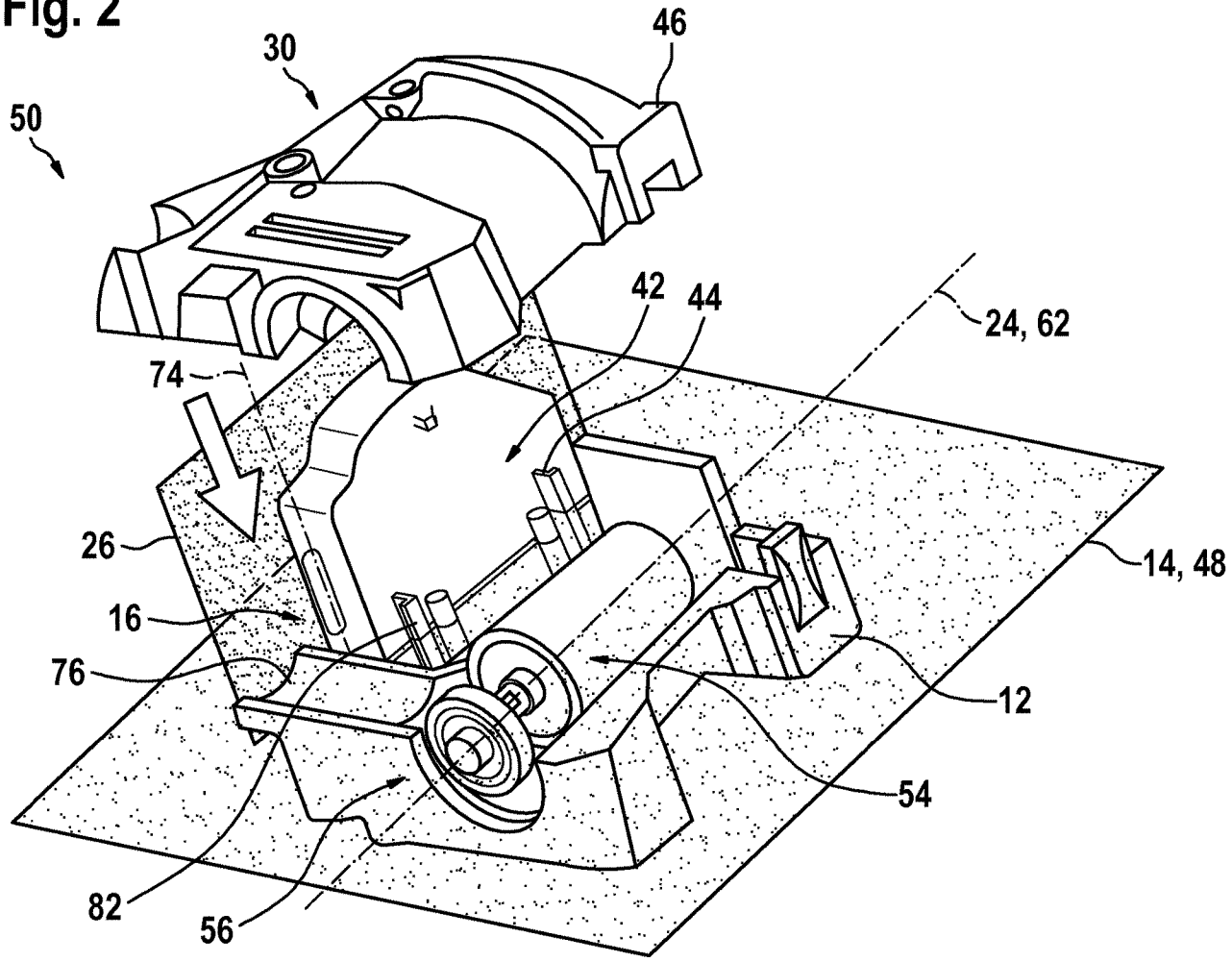
FIG. 2 shows in a schematic representation a detailed view of the sanding machine housing device according to the disclosure having a housing element of the sanding machine housing device according to the disclosure, which housing element is removed from a further housing element of the sanding machine housing device according to the disclosure.
Figure 3:
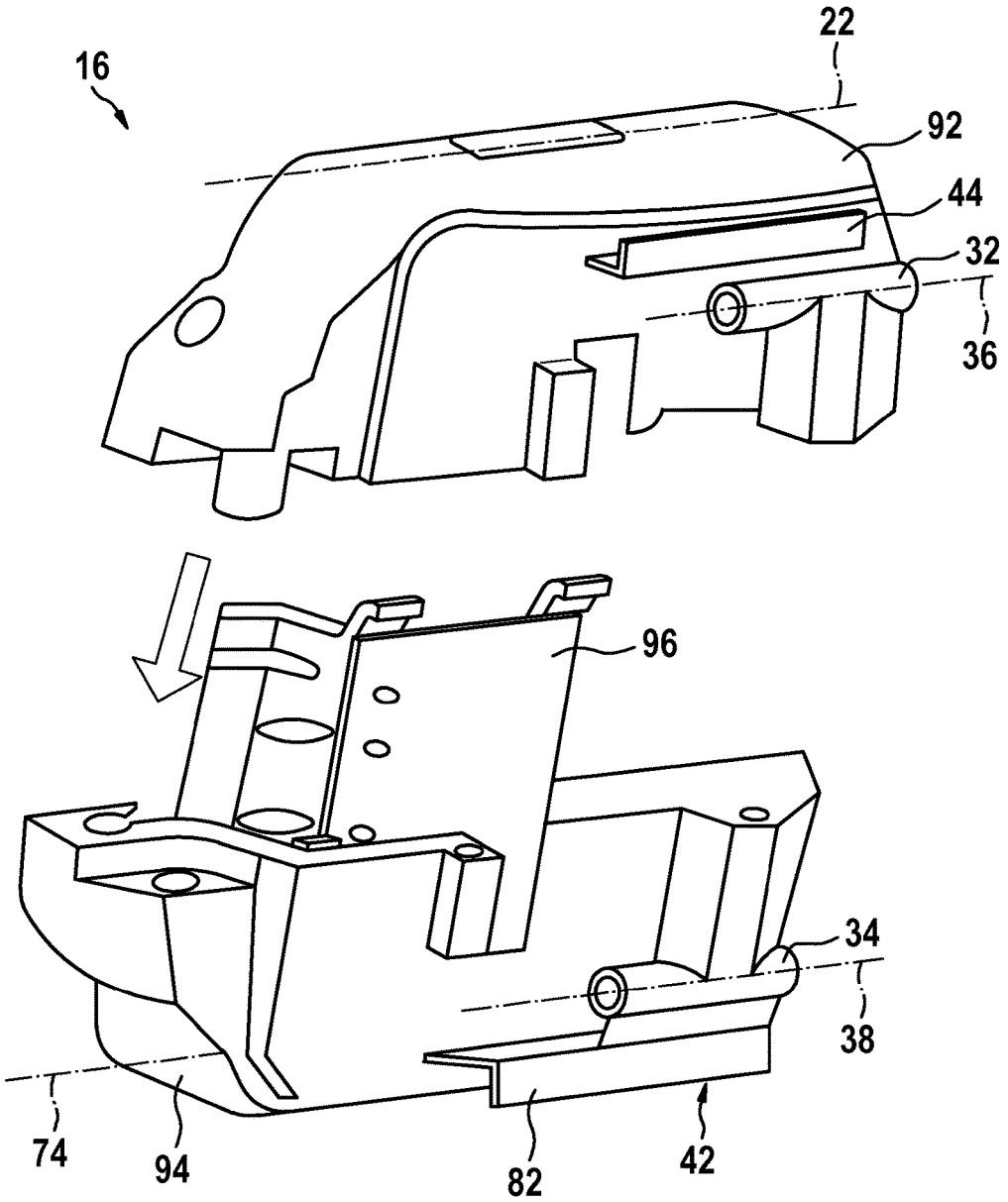
FIG. 3 shows in a schematic representation a detailed view of an energy store receiving interface of the sanding machine housing device according to the disclosure.

Furthermore, the sanding machine housing device 10 has at least one assembly guide unit 42, which is adapted to guide the energy store receiving interface 16 during mounting on the housing element 12 (FIGS. 2 and 3). The assembly guide unit 42 comprises at least one rib-shaped assembly guide element 44 disposed in the assembly region of the energy store receiving interface 16, for positive and/or non-positive connection to the housing element 12. In total, the assembly guide unit 42 has at least two assembly guide elements 44. It is also conceivable, however, for the assembly guide unit 42 to have a number of assembly guide elements 44, 82 which differs from two. The housing element 12 comprises at least two assembly guide recesses 84, 86 configured correspondingly to the assembly guide element 44, 82. The assembly guide unit 42 thus additionally comprises at least one assembly guide recesses 84, 86 disposed on the housing element 12. For mounting of the energy store receiving interface 16 on the housing element 12 during an assembly process of the sanding machine housing device 10, and thus of the portable power tool 50, the assembly guide elements 44, 82 are introduced into the assembly guide recesses 84, 86 along a direction running at least substantially perpendicular to the drive axis and output axis plane 14. Following insertion, the energy store receiving interface 16 is moved translatorily relative to the housing element 12 until the fastening elements 32, 34 butt against the housing element 12. The energy store receiving interface 16 can here be disposed in such a way on the housing element 12 that an arrangement of the energy storage device 18 is suitable for left handers or for right handers. Depending on the preferred arrangement of the energy store receiving interface 16, the energy storage device 18 can thus be slid in from the left or from the right.

In addition, the sanding machine housing device 10 has at least one damping unit 40, which is disposed at least between the housing element 12 and the energy store receiving interface 16 (FIG. 5). The damping unit 40 comprises at least one damping element 80, which is disposed in at least one of the assembly guide recesses 84, 86. In total, the damping unit 40 has at least two damping elements 80, 88, wherein respectively one of the damping elements 80, 88 is assigned to one of the assembly guide recesses 84, 86. It is also conceivable, however, for the damping unit 40 to comprise a number of damping elements 80, 88 which differs from two. The damping elements 80, 88 are here configured in one piece with a soft grip (not represented in detail here) of the sanding machine housing device 10. In a mounted state of the sanding machine housing device 10, the soft grip is disposed in a handle region of the sanding machine housing device 10.

The sanding machine housing device 10 comprises at least one further housing element 46, which is connectable to the first housing element 12 in a separation plane 48 running at least substantially parallel to the drive axis and output axis plane 14 (FIG. 2). The drive axis and output axis plane 14 is here formed by the separation plane 48 of the sanding machine housing device 10. The housing element 12 and the further housing element 46 are fastenable to each other by means of at least one connecting element 90 of the sanding machine housing device 10 (FIGS. 4 and 5). In FIGS. 4 and 5, the further housing element 46 is disassembled from the housing element 12, yet the connecting element 90 is represented disposed on the housing element 12. The connecting element 90 is here configured as a screwing element, in particular as a screw. It is also conceivable, however, for the connecting element 90 to have a different configuration which appears sensible to a person skilled in the art. In total, the sanding machine housing device 10 has at least four connecting elements 90. It is also conceivable, however, for the sanding machine housing device 10 to have a number of connecting elements 90 which differs from four.

In FIG. 3, the energy store receiving interface 16 is represented in exploded representation in a state disassembled from the housing element 12. The energy store receiving interface 16 here comprises at least two receiving housing elements 92, 94. The receiving housing elements 92, 94 are here fastenable to each other by means of a positive and/or non-positive connection. In this case, respectively a receiving guide element 20, 72 and respectively an assembly guide element 44, 82 are disposed on one of the receiving housing elements 92, 94. In addition, the receiving housing elements 92, 94 are adapted to receive the contact plate 96 of the energy store receiving interface 16. To this end, in a state of the receiving housing elements 92, 94 in which these are arranged adjacent to each other, the contact plate 96 is disposed between the receiving housing elements 92, 94. The contact plate 96 comprises contacts for a transmission of electrical energy for energization of the drive unit 54 in at least an operating state in which the energy storage device 18 is disposed on the energy store receiving interface 16.

The invention claimed is:

1. A sanding machine housing device, comprising:

at least one housing element configured to support a drive unit and a tool holder relative thereto, the housing element at least partially defining a drive axis and output axis plane within which an armature shaft of the drive unit extends, the armature shaft defining a drive axis of the drive unit and the tool holder having a rotational axis oriented parallel to the drive axis; and at least one energy store receiving interface disposed on the housing element and configured to secure at least one energy storage device in a releasable manner, wherein the energy store receiving interface comprises at least two receiving guide elements that are spaced from one another and define respective parallel principal guide axes running at least substantially transversely to the drive axis and output axis plane, the receiving guide elements configured to restrict a motion of the energy storage device relative to the energy store receiving interface to a direction parallel to the principal guide axes, wherein the tool holder has a tool holder motional plane oriented perpendicular to the drive axis, the principal guide axes running substantially parallel to the tool holder motional plane, and wherein the principal guide axes define a receiving guide plane of the energy store receiving interface, the receiving guide plane oriented transversely to the tool holder motional plane.

2. The sanding machine housing device as claimed in claim 1, wherein, when viewed in the drive axis and output axis plane, an intersection of the receiving guide plane and the drive axis forms an angle which is less than 80°.

3. The sanding machine housing device as claimed in claim 2, wherein the intersection of the receiving guide plane and the drive axis occurs on a side of the housing element that is opposite a side on which the tool holder is supported.

4. The sanding machine housing device as claimed in claim 1, wherein the energy store receiving interface is disposed on a longitudinal side of the housing element.

5. The sanding machine housing device as claimed in claim 1, wherein the energy store receiving interface comprises at least one assembly region, which has at least one fastening element configured to fasten the energy store receiving interface to the housing element, which latter, viewed in a state mounted on the housing element, has a fastening axis running at least substantially transversely to the drive axis and output axis plane.

6. The sanding machine housing device as claimed in claim 1, further comprising at least one damping unit disposed at least between the housing element and the energy store receiving interface.

7. The sanding machine housing device as claimed in claim 1, wherein the energy store receiving interface comprises at least one assembly guide unit configured to guide the energy store receiving interface in a translatory manner during mounting on the housing element.

8. The sanding machine housing device as claimed in claim 7, wherein the assembly guide unit comprises at least one rib-shaped assembly guide element disposed in an assembly region of the energy store receiving interface for one or more of a positive and a non-positive connection to the housing element.

9. The sanding machine housing device as claimed in claim 8, wherein the rib-shaped assembly guide element comprises a first wall extending from a side of the energy store receiving interface that is opposite a side on which the receiving guide element is disposed.

10. The sanding machine housing device as claimed in claim 9, wherein the rib-shaped assembly guide element comprises a second wall that extends transversely from the first wall.

11. The sanding machine housing device as claimed in claim 9, wherein the first wall extends in a direction parallel to the principal guide axis.

12. The sanding machine housing device as claimed in claim 7, wherein the at least one assembly guide unit guides the energy store receiving interface in a direction substantially transversely to the drive axis and output axis plane.

13. The sanding machine housing device as claimed in claim 12, wherein the energy store receiving interface includes a first interface portion and a second interface portion each formed as a separate unitary body, the first and second interface portions connected to one another to form the energy store receiving interface.

14. The sanding machine housing device as claimed in claim 13, wherein the at least one assembly guide unit includes a first assembly guide unit and a second assembly guide unit, wherein the first interface portion includes the first assembly guide unit, and wherein the second interface portion includes the second assembly guide unit.

15. The sanding machine housing device as claimed in claim 1, further comprising at least one further housing element that is connectable to the housing element in a separation plane running at least substantially parallel to the drive axis and output axis plane.

16. The sanding machine housing device as claimed in claim 1, further comprising an output unit supported by the housing element, the output unit disposed between the drive unit and the tool holder and having an output axis that extends in the drive axis and output axis plane, wherein the tool holder is driven by interaction of the drive unit and the output unit such that the tool holder oscillates eccentrically about the rotation axis of the tool holder.

17. A portable power tool, comprising:

at least one sanding machine housing device including:

at least one housing element configured to support a drive unit and a tool holder relative thereto, the housing element at least partially defining a drive axis and output axis plane within which an armature shaft of the drive unit extends, the armature shaft defining a drive axis of the drive unit and the tool holder having a rotational axis oriented parallel to the drive axis; and at least one energy store receiving interface disposed on the housing element and configured to secure at least one energy storage device in a releasable manner, wherein the energy store receiving interface comprises at least two receiving guide elements that are spaced from one another and define respective parallel principal guide axes running at least substantially transversely to the drive axis and output axis plane, the receiving guide element configured to restrict a motion of the energy storage device relative to the energy store receiving interface to a direction parallel to the principal guide axes, wherein the tool holder has a tool holder motional plane oriented perpendicular to the drive axis, the principal guide axes running substantially parallel to the tool holder motional plane, and wherein the principal guide axes define a receiving guide plane of the energy store receiving interface, the receiving guide plane oriented transversely to the tool holder motional plane.

18. A sanding machine housing device, comprising:

at least one housing element that at least partially defines a drive axis and output axis plane, the drive axis and output axis plane delimiting opposite first and second sides of the housing element; and exactly one energy store receiving interface disposed on the housing element and configured to secure exactly one energy storage device in a releasable manner, wherein the energy store receiving interface comprises at least one receiving guide element that defines a principal guide axis running at least substantially transversely to the drive axis and output axis plane, and wherein the receiving guide element is configured to initially receive the energy storage device (i) from the first side of the housing element in a first arrangement of the energy store receiving interface on the housing element and (ii) from the second side of the housing element in a second arrangement of the energy store receiving interface on the housing element.

19. The sanding machine housing device as claimed in claim 18, wherein the energy store receiving interface defines a receiving guide plane in which the principal guide axis runs, and wherein the energy store receiving interface in the second arrangement is rotated approximately 180° relative to the first arrangement about an axis oriented normal to the receiving guide plane.

* * * * *